US009027660B2

(12) United States Patent
Oldham

(10) Patent No.: US 9,027,660 B2
(45) Date of Patent: May 12, 2015

(54) SHIPPING CAP FOR FIRE PROTECTION SPRINKLER

(71) Applicant: The Viking Corporation, Hastings, MI (US)

(72) Inventor: Michael J. Oldham, Kalamazoo, MI (US)

(73) Assignee: The Viking Corporation, Hastings, MI (US)

( * ) Notice: Subject to any disclaimer, the term of this patent is extended or adjusted under 35 U.S.C. 154(b) by 304 days.

(21) Appl. No.: 13/647,038

(22) Filed: Oct. 8, 2012

(65) Prior Publication Data

US 2014/0096982 A1 Apr. 10, 2014

(51) Int. Cl.

| | |
|---|---|
| ***A62C 31/28*** | (2006.01) |
| ***B05B 15/00*** | (2006.01) |
| ***B65D 25/00*** | (2006.01) |
| ***A62C 37/08*** | (2006.01) |
| *B05B 1/26* | (2006.01) |

(52) U.S. Cl.

CPC ..... *A62C 37/08* (2013.01); *B65D 25/005* (2013.01); *B05B 15/001* (2013.01); *A62C 31/28* (2013.01); *B05B 1/265* (2013.01); *B05B 1/267* (2013.01)

(58) Field of Classification Search

CPC ..... A62C 31/28; B05B 15/001; B65D 1/40; B65D 25/005

USPC ..... 169/37, 41, 42, 51; 239/288, 288.3, 239/288.5; 206/418; 220/724

See application file for complete search history.

(56) References Cited

U.S. PATENT DOCUMENTS

| | | | | |
|---|---|---|---|---|
| 3,801,014 | A * | 4/1974 | Cantales | 239/104 |
| 4,830,118 | A * | 5/1989 | Capasso | 169/90 |
| 5,570,745 | A | 11/1996 | MacDonald, III | |
| 5,632,339 | A * | 5/1997 | Fenske et al. | 169/37 |
| 6,669,111 | B2 * | 12/2003 | Vinson et al. | 239/288 |
| 7,273,189 | B2 | 9/2007 | Ide et al. | |
| 7,540,330 | B2 * | 6/2009 | Orr et al. | 169/37 |
| 7,540,380 | B2 | 6/2009 | Kohs et al. | |
| 7,757,967 | B1 | 7/2010 | Yang | |
| 7,854,269 | B2 | 12/2010 | Franson et al. | |
| 7,900,852 | B2 | 3/2011 | Feenstra | |
| 2004/0134670 | A1 | 7/2004 | Orr et al. | |
| 2008/0047718 | A1 | 2/2008 | Orr et al. | |
| 2010/0132962 | A1 | 6/2010 | Silva, Jr. et al. | |
| 2011/0121100 | A1 | 5/2011 | Feenstra | |

* cited by examiner

*Primary Examiner* — Ryan Reis

(74) *Attorney, Agent, or Firm* — Harness, Dickey & Pierce, P.L.C.

(57) ABSTRACT

A shipping cap for a sprinkler includes a main body having a hollow annular wall portion having a closed upper end. A first pair of side legs extend laterally and axially from a first side of the cylindrical wall portion and a second pair of side legs extend laterally from a second side of the cylindrical wall portion. A first side curtain extends from one of the first pair of side legs and one of the second pair of side legs and a second side curtain extends from the other of the first pair of side legs and the other of the second pair of side legs.

17 Claims, 4 Drawing Sheets

SHIPPING CAP FOR FIRE PROTECTION SPRINKLER

FIELD

The present disclosure relates to a shipping cap for a fire protection sprinkler.

BACKGROUND

This section provides background information related to the present disclosure which is not necessarily prior art. The present disclosure is directed to a protective cover or shipping cap for a fire protection sprinkler. The cover is adapted to releasably engage the sprinkler so that the cover will remain attached to the sprinkler during handling and installation to ease handling and, further, protect the deflector and the trigger mechanism during normal shipping, handling and installation of the sprinkler.

SUMMARY

This section provides a general summary of the disclosure, and is not a comprehensive disclosure of its full scope or all of its features.

A shipping cap for a sprinkler includes a main body having a hollow annular wall portion having a closed or substantially closed upper end. A first pair of side legs extend laterally and axially from a first side of the cylindrical wall portion and a second pair of side legs extend laterally from a second side of the cylindrical wall portion. A first side curtain extends from one of the first pair of side legs and one of the second pair of side legs and a second side curtain extends from the other of the first pair of side legs and the other of the second pair of side legs.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
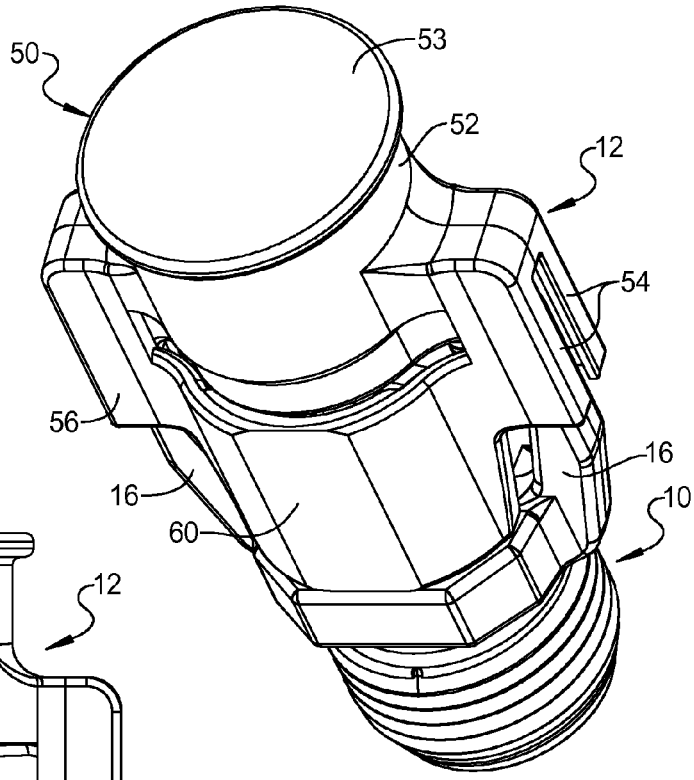
FIG. 1 is a perspective view of a fire protection sprinkler and shipping cap assembly according to the principles of the present disclosure.
Figure 2:
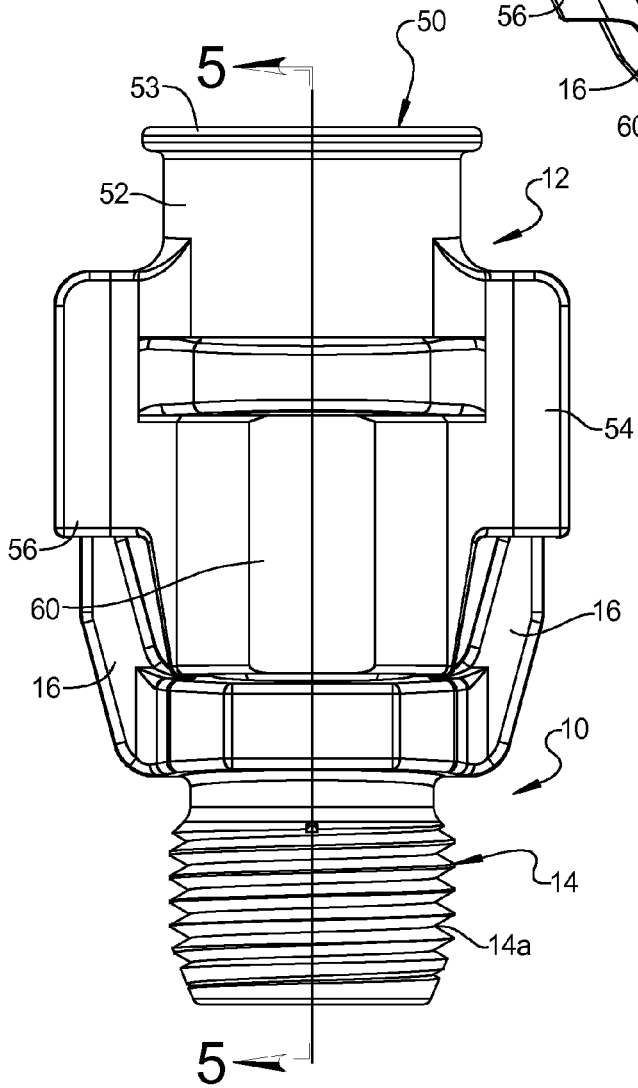
FIG. 2 is a front plan view of the assembly shown in FIG. 1.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 4:
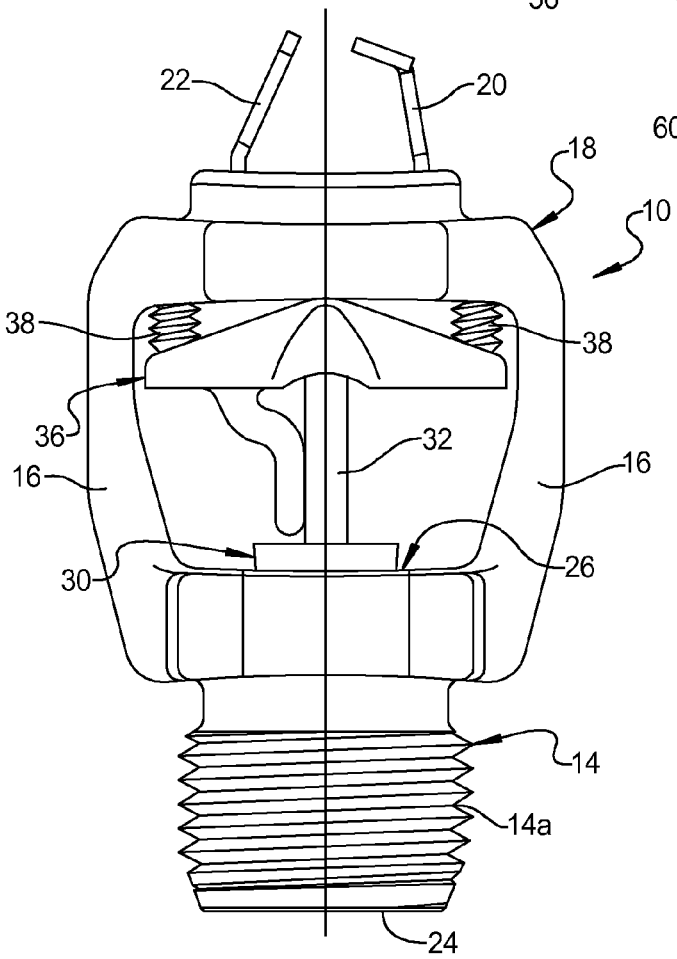
FIG. 4 is a front plan view of an exemplary fire protection sprinkler according to the principles of the present disclosure.
Figure 5:
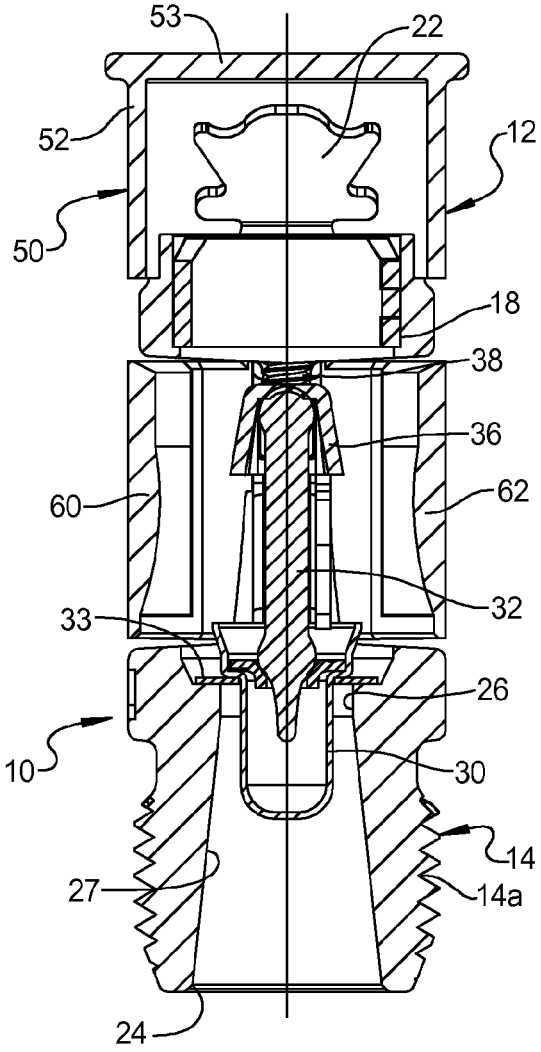
FIG. 5 is a cross-sectional view of the fire protection sprinkler and shipping cap assembly according to the principles of the present disclosure.

With reference to FIG. 1, a fire protection sprinkler 10 is shown including a shipping cap 12 mounted thereto. With reference to FIGS. 4 and 5, the fire protection sprinkler 10 includes a sprinkler body 14 having a pair of frame arms 16 extending therefrom. The pair of frame arms 16 can include an annular support portion 18 at a distal end thereof. Annular support portion 18 can include a pair of flow shaper tabs 20, 22 that shape the flow of fluid through the opening in the annular support portion 18. The body 14 includes a generally tubular body with a threaded portion 14*a* for connecting the sprinkler assembly to a fluid supply line, and further includes an inlet opening 24, a discharge opening 26, and a fluid passageway extending therebetween. A closure device 30 is releasably positioned at the discharge opening 26 of the body 14 to close the passageway. As shown in FIG. 5, an annular spring seal 33 surrounds the closure device 30 and is seated against the body 14 to close the discharge opening 26. A heat responsive trigger 32 is mounted in a manner to releasably retain the closure device 30 at the discharge opening 26 of body 14 to thereby maintain the passageway closed until the trigger 32 is activated.

To reduce the energy loss of the fluid as it flows from the sprinkler assembly 10, annular support portion 18 is configured to allow at least a portion and, optionally most, if not all, of the fluid to flow through the annular support portion 18 rather than into and around the support 18. In addition, as will be more fully described below, at least a portion, and optionally most of the fluid flows between one or more flow-shaper members 20, 22, which direct and shape the fluid in a desired pattern in contrast to conventional sprinkler assemblies that typically include frames and deflectors that deflect and redirect the fluid and form barriers around which the fluid must flow.

In the illustrated embodiment, the annular support portion 18 is supported by the frame arms 16, and joins the ends of the arms 16 and which is spaced from the discharge opening 26. The arms 16 extend generally away from the discharge opening 26 on opposed sides of the body 14, and as noted, are joined by the annular support portion 18. While two symmetrically positioned arms are illustrated, it should be understood that the annular support portion 18 may include one, two, three, or four or more arms, for example three or four arms for support thereof. As would be understood by those skilled in the art, annular support portion 18 is substantially rigid so as to provide support for the flow shaper members 20, 22, and further support for the heat responsive trigger 32. The heat responsive trigger 32 can include a heat sensitive bulb as is well known in the art. It should be understood that the heat responsive member may alternatively be formed from a fused link, such as is well known in the art. Heat sensitive member 32 is supported on one end on the closure device 30. The other end of the heat responsive member 32 is mounted to the frame arms 16 by a transverse compression member such as yoke 36. Yoke 36 extends between arms 16 below the support member 18 and comprises a hollow wedge-shape member with a slotted recess for holding the larger end of the heat sensitive member 32 therein. The yoke 36 is supported in position by the heat sensitive member 32 and two compression screws or fasteners 38 that extend through the transverse recesses or openings provided in the support 18 to thereby compress the yoke 36 against the trigger member 32. It is noted that the sprinkler assembly, as described hereinabove, is more fully described in greater detail in commonly assigned U.S. Pat. No. 7,854,269. which is herein incorporated by reference in its entirety.

Figure 3:
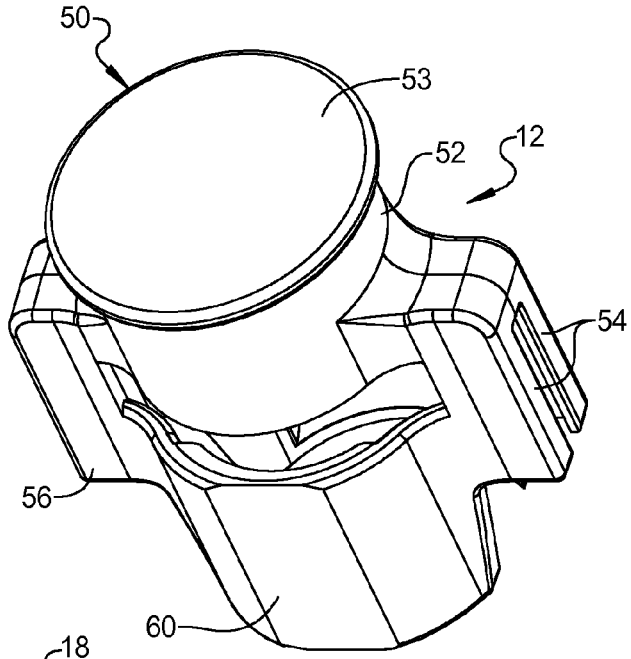
FIG. 3 is a perspective view of the shipping cap according to the principles of the present disclosure.
Figure 6:
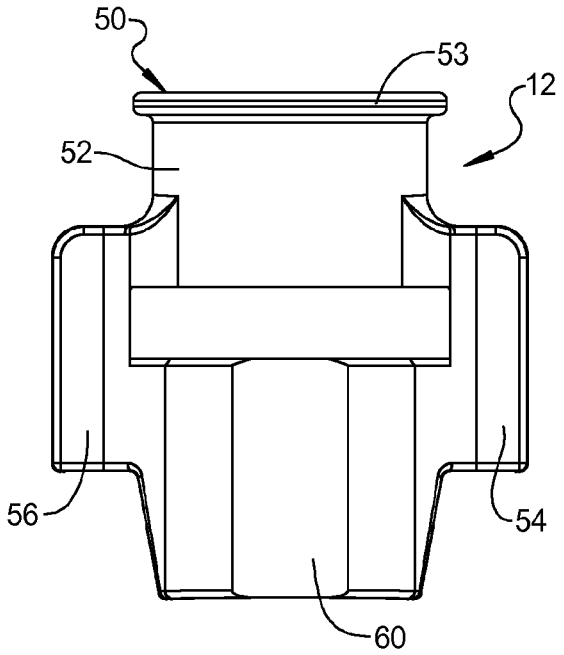
FIG. 6 is a front plan view of the shipping cap shown in FIG. 3.

With reference to FIGS. 3 and 6, the shipping cap 12 includes a main body 50 having a hollow annular wall portion 52 having a closed or substantially closed upper end defined by an end wall 53. As best shown in FIG. 3, a first pair of side legs 54 extend laterally and axially from a first side of the annular wall portion 52. A second pair of side legs 56 extends laterally from a second side of the annular wall portion 52. A first side curtain 60 extends from one of the first pair of side legs 54 and one of the second pair of side legs 56. A second side curtain 62 extends from the other of the first pair of side legs 54 and the other of the second pair of side legs 56. As shown in FIG. 8, the side curtains 60, 62 have a beveled upper edge surface 60*a*. 62*a* that are spaced axially from the annular wall portion 52 of the main body 50 by a gap space G, as illustrated in FIG. 7.

Figure 7:
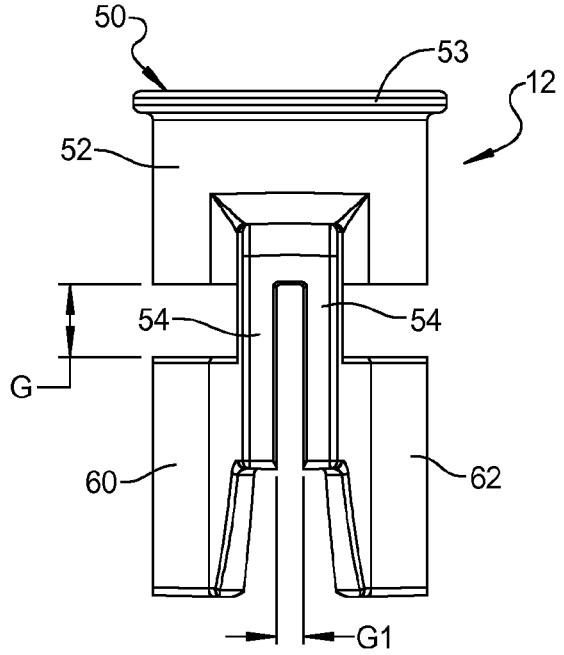
FIG. 7 is a side view of the shipping cap shown in FIG. 3.
Figure 8:
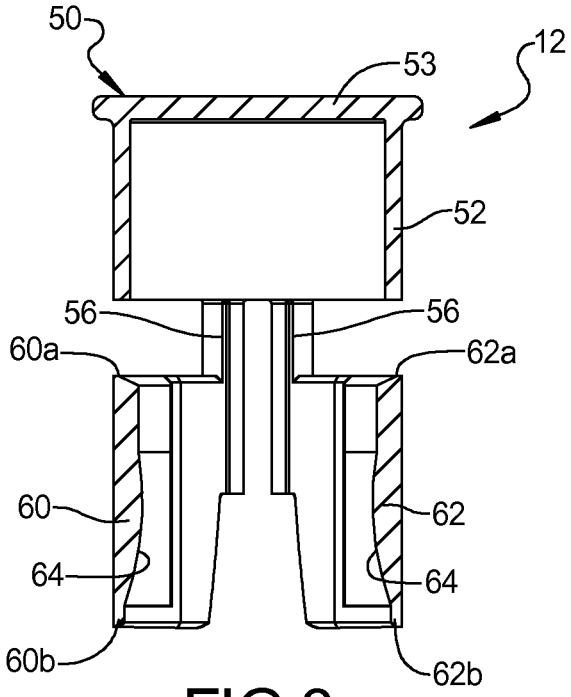
FIG. 8 is a cross-sectional view of the shipping cap shown in FIG. 6.
Figure 9:
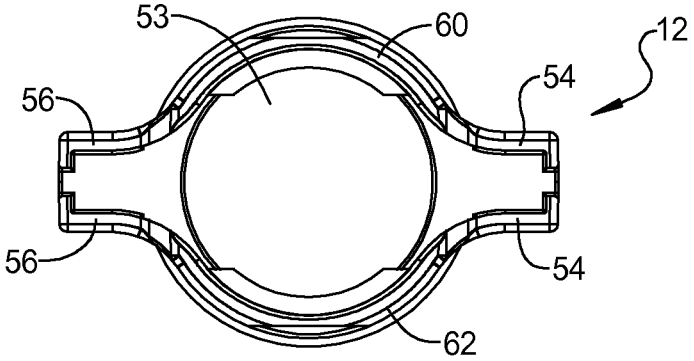
FIG. 9 is a bottom plan view of the shipping cap according to the principles of the present disclosure.

In addition, as shown in FIGS. 7 and 8, each of the side legs 54, 56 are spaced from its adjacent pair by a separate gap G1. The distal ends 60*b*. 62*b* of the side curtains 60, 62 are beveled inward as illustrated at reference numeral 64, as shown in FIG. 8. The beveled features 64 allow the side curtains 60, 62 to be slid over the annular support portion 18 of the sprinkler 10 so that the annular support portion 18 is received between the beveled upper edge 60*a*. 62*a* and the lower edge of the annular wall portion 52 of the main body 50.

When the shipping cap 12 is properly installed, the flow shaper tabs 20, 22 are received within the hollow portion of the main body 50 and the side curtains 60, 62 protect the frangible bulb 32 from damage during shipping and handling. The beveled upper edge 60*a*. 62*a* of each sidewall 60, 62 facilitate the easy removal of the shipping cap 12 which can be grasped by the main body 50 and pulled axially relative to the body 14 of the fire protection sprinkler 10. The shipping cap 12 locks onto the sprinkler 10 by utilizing a pinching action instead of the traditional wedging type protrusions utilized in other shipping caps which engage the deflector of the fire protection sprinklers. This pinching action relies upon a slot created between the side curtains 60, 62 that allow for the cap to spread apart when the cap 12 is installed onto the sprinkler 10. Once the cap 12 has passed over the annular support portion 18 of the sprinkler 10, the spread cap 12 is allowed to regain its previous shaped, thereby securing the cap 12 onto the sprinkler 10. Unlike other caps or clips, this unique design allows for an easy installation without the use of any snaps or wedge-type protrusions. The design of the slots and the thickness of the material around the slot are designed in order to determine the amount of force that is required to spread the cap 12 for installation and removal from the sprinkler 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A shipping cap for a sprinkler, comprising:

a main body having a hollow annular wall portion having a substantially closed upper end;

a first pair of side legs extending laterally and axially from a first side of said annular wall portion with a first gap with no material disposed between the first pair of side legs and a second pair of side legs extending laterally from a second side of said annular wall portion with a second gap with no material disposed between the second pair of side legs; and a first side curtain extending from one of said first pair of side legs and one of said second pair of side legs and a second side curtain extending from the other of said first pair of side legs and the other of said second pair of side legs.

2. The shipping cap according to claim 1, wherein said first and second side curtains are spaced axially from said wall portion of said main body by a gap space.

3. The shipping cap according to claim 1, wherein said main body, said first and second pairs of side legs and said first and second side curtains are integrally formed as a unitary member.

4. The shipping cap according to claim 1, wherein said main body, said first and second pairs of side legs and said first and second side curtains are integrally formed as a unitary member from a plastic material.

5. The shipping cap according to claim 1, wherein said hollow annular wall portion is generally cylindrical.

6. The shipping cap according to claim 1, wherein said first and second side curtains each include a proximal end closest to said main body and a distal end furthest from said main body, said first and second side curtains having an inner surface at said distal end that bevels inward toward a central axis of said main body.

7. The shipping cap according to claim 6, wherein at least a portion of said inner surface of said first and second curtains has a smaller distance therebetween than an inner diameter of said hollow annular wall portion of said main body.

8. A fire protection sprinkler and protective cap assembly, comprising:

the fire protection sprinkler including a body including a passageway, an inlet opening, a discharge opening and an axis extending through said discharge opening, a pair of frame arms extending from said body, and an annular member supported by said pair of frame arms and having an opening at least generally aligned with said axis; and the protective cap including a main body having a hollow annular wall portion receiving at least a portion of said annular member therein, a first side curtain extending from one side of said wall portion and a second side curtain extending from a second side of said wall portion with a pair of gaps with no material between opposite circumferential ends of said first and second side curtains, said first and second side curtains including an axial facing edge surface spaced from and facing sain annular wall portion of said main body and engaging said annular member to retain said protective cap on said fire protection sprinkler.

9. The assembly according to claim 8, wherein said first and second side curtains are spaced axially from said wall portion of said main body by a gap space.

10. The assembly according to claim 8, wherein said main body and said first and second side curtains are integrally formed as a unitary member.

11. The assembly according to claim 8, wherein said main body and said first and second side curtains are integrally formed as a unitary member from a plastic material.

12. The assembly according to claim 8, wherein said hollow annular wall portion is generally cylindrical.

13. The assembly according to claim 8, wherein said first and second side curtains each include a proximal end closest to said main body and a distal end furthest from said main body, said first and second side curtains having an inner surface at said distal end that bevels inward toward a central axis of said main body.

14. The assembly according to claim 13, wherein at least a portion of said inner surface of said first and second curtains has a smaller distance therebetween than an inner diameter of said hollow annular wall portion of said main body.

15. The assembly according to claim 8, wherein said first and second side curtains are each connected to said hollow annular wall portion by a pair of axially extending legs.

16. The assembly according to claim 15, wherein said frame arms of said fire protection sprinkler are each disposed between two of said axially extending legs.

17. The assembly according to claim 8, wherein said fire protection sprinkler includes a pair of flow shaper tabs extending from said annular member, said pair of flow shaper tabs being disposed within said hollow annular wall of said protective cap.

* * * * *

UNITED STATES PATENT AND TRADEMARK OFFICE

CERTIFICATE OF CORRECTION

PATENT NO. : 9,027,660 B2
APPLICATION NO. : 13/647038
DATED : May 12, 2015
INVENTOR(S) : Michael J. Oldham It is certified that error appears in the above-identified patent and that said Letters Patent is hereby corrected as shown below:

In the Specification:

At column 4, line number 7, delete "7,854,269." and insert --7,854,269,-- therefor.

At column 4, line number 21, delete "60a. 62a" and insert --60a, 62a-- therefor.

At column 4, line number 26, delete "60b. 62b" and insert --60b, 62b-- therefor.

At column 4, line number 31, delete "60a. 62a" and insert --60a, 62a-- therefor.

At column 4, line number 37, delete "60a. 62a" and insert --60a, 62a-- therefor.

In the Claims:

At column 6, claim number 8, line number 10, delete "sain" and insert --said-- therefor.

Signed and Sealed this
Twenty-first Day of June, 2016

Michelle K. Lee

Michelle K. Lee
*Director of the United States Patent and Trademark Office*